US007900931B2

(12) United States Patent
Cornish

(10) Patent No.: US 7,900,931 B2
(45) Date of Patent: Mar. 8, 2011

(54) BALANCING MECHANISM FOR AN EQUILIBRIUM GAME

(76) Inventor: Douglas H. Cornish, Silver Spring, MD (US)

( * ) Notice: Subject to any disclaimer, the term of this patent is extended or adjusted under 35 U.S.C. 154(b) by 0 days.

(21) Appl. No.: 12/457,567

(22) Filed: Jun. 16, 2009

(65) Prior Publication Data

US 2010/0314832 A1 Dec. 16, 2010

(51) Int. Cl.
*A63F 9/26* (2006.01)

(52) U.S. Cl. ..... 273/450; 273/449

(58) Field of Classification Search ..... 273/449, 273/450, 459, 440; 446/396; 177/171, 191, 177/192, 199, 235, 246
See application file for complete search history.

(56) References Cited

U.S. PATENT DOCUMENTS

| | | | | | |
|---|---|---|---|---|---|
| 276,524 | A * | 4/1883 | Crosby | 446/396 |
| 409,191 | A * | 8/1889 | Glover | 177/171 |
| 1,851,223 | A * | 3/1932 | Watanabe | 40/493 |
| 3,092,384 | A * | 6/1963 | Herne | 273/459 |
| 3,402,929 | A * | 9/1968 | Glass et al. | 273/447 |
| 3,614,106 | A * | 10/1971 | Morrison et al. | 273/156 |
| 4,358,110 | A * | 11/1982 | Youkstetter | 273/450 |
| 4,708,342 | A * | 11/1987 | Davis | 273/450 |
| 6,583,368 | B2 | 6/2003 | Pivinski | 177/171 |
| 7,178,805 | B2 * | 2/2007 | Herbolich, Jr. | 273/449 |

* cited by examiner

*Primary Examiner* — Raleigh W. Chiu
(74) *Attorney, Agent, or Firm* — Welsh Flaxman & Gitler LLC

(57) ABSTRACT

A balancing mechanism for an equilibrium game wherein a hub is connected to a tripod by a universal joint. A plurality of radially extending arms having cups on their outer ends are connected to the hub. A depending pointer is connected to the hub and extends downwardly therefrom to a Cartesian coordinate graph positioned centrally of the tripod. A plurality of weights are placed in the cups to cause the pointer to become positioned at a certain X,Y point on the graph.

4 Claims, 7 Drawing Sheets

BALANCING MECHANISM FOR AN EQUILIBRIUM GAME

BACKGROUND OF THE INVENTION

Various games of chance have been proposed over the years wherein a player tries to predict the outcome of an event and places a bet on the outcome. Roulette is one such game in which players bet in which numbered compartment of a revolving wheel a small ball will come to rest.

After considerable research on experimentation, the equilibrium game of the present invention has been devised wherein a number of players bet on the final equilibrium position of a balancing mechanism.

SUMMARY OF THE INVENTION

The balancing mechanism of the present invention comprises, essentially, a tripod having a hub connected to the upper end thereof by a universal joint. A plurality of inclined arms have their upper end portions connected to the hub, and a container or cup is connected to the lower end portion of each arm. A depending indicator having a pointer is connected to the hub and extends downwardly therefrom to a Cartesian coordinate graph, whereby when weights such as marbles are placed in the containers, the arms are caused to tilt off center from the horizontal to an equilibrium position resulting in the indicator pointing to a certain point or position on the Cartesian coordinate graph.

DETAILED DESCRIPTION OF THE PREFERRED EMBODIMENTS

Figure 1:
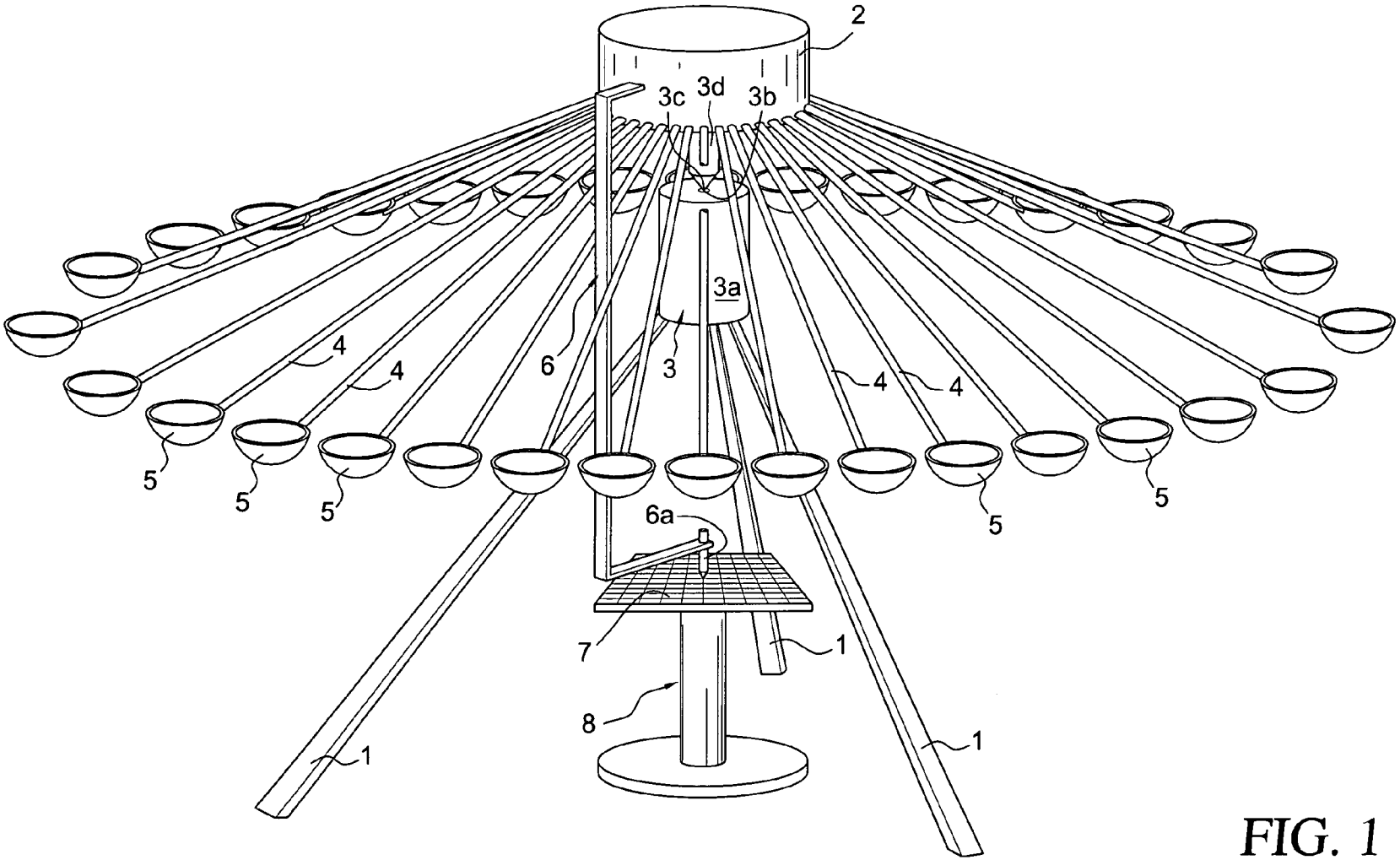
FIG. 1 is a front perspective view of the balancing mechanism of the present invention.

Referring to the drawings and more particularly to FIG. 1, the balancing mechanism of the present invention comprises a tripod 1 having a hub 2 connected to the upper end thereof by a universal joint 3 provided by a base 3*a* connected to the upper end of the tripod 1 and having a spherical recess 3*b* formed in the upper surface thereof for receiving the pointed end 3*c* of a depending spindle 3*d* fixed to the bottom surface of the hub 2.

A plurality of inclined arms 4 have their upper end portions connected to the hub 2 and a container or cup 5 is connected to the lower end portion of each arm 4.

A depending indicator 6 having a pointer 6*a* is connected to the hub 2 and extends downwardly therefrom to a Cartesian coordinate graph 7 supported on a table top 8 positioned centrally within the tripod 1.

Figure 2:
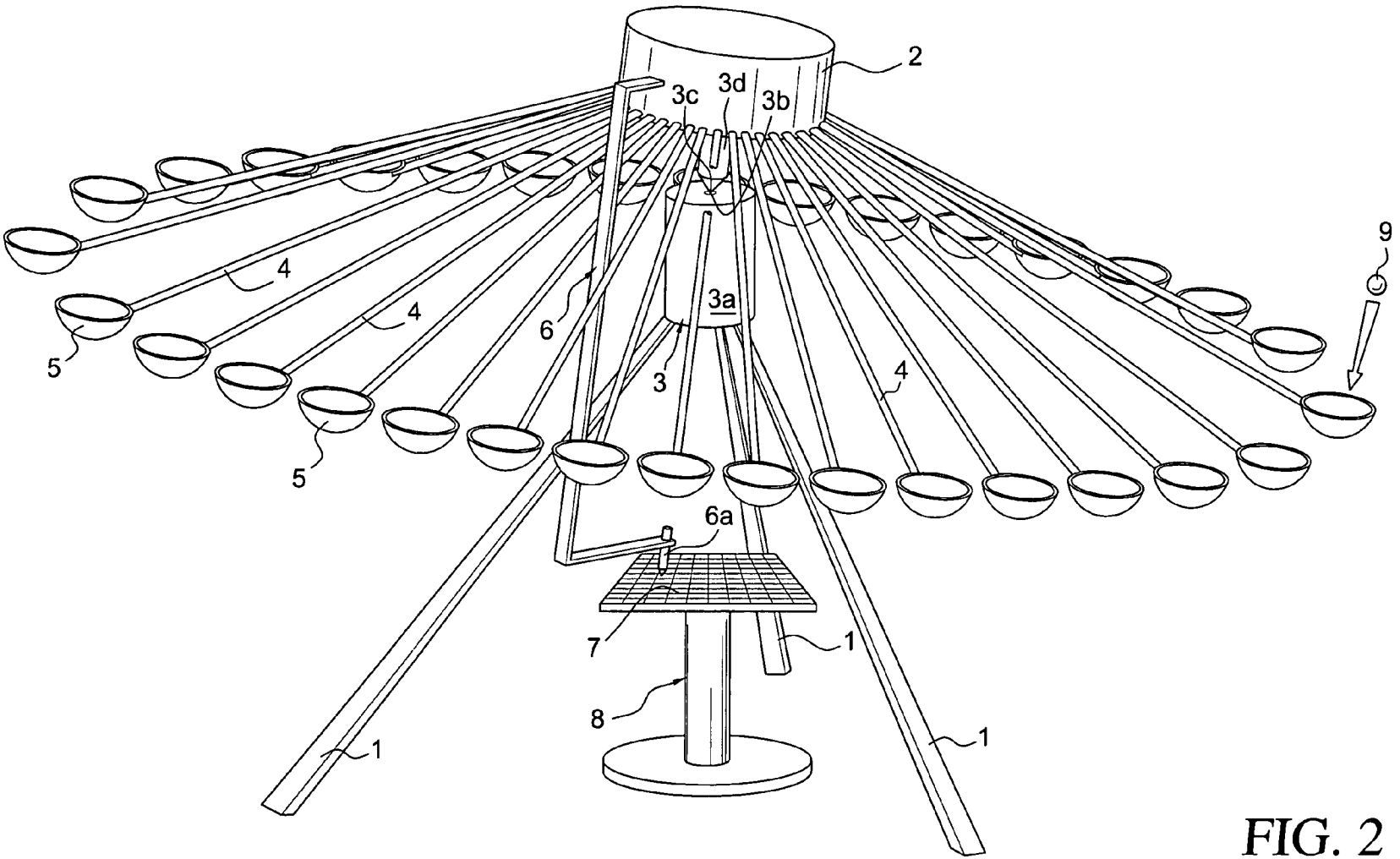
FIG. 2 is a front perspective view of the mechanism showing a ball being placed in one of the cups on the right side thereby tilting the balancing mechanism to the right.
Figure 3:
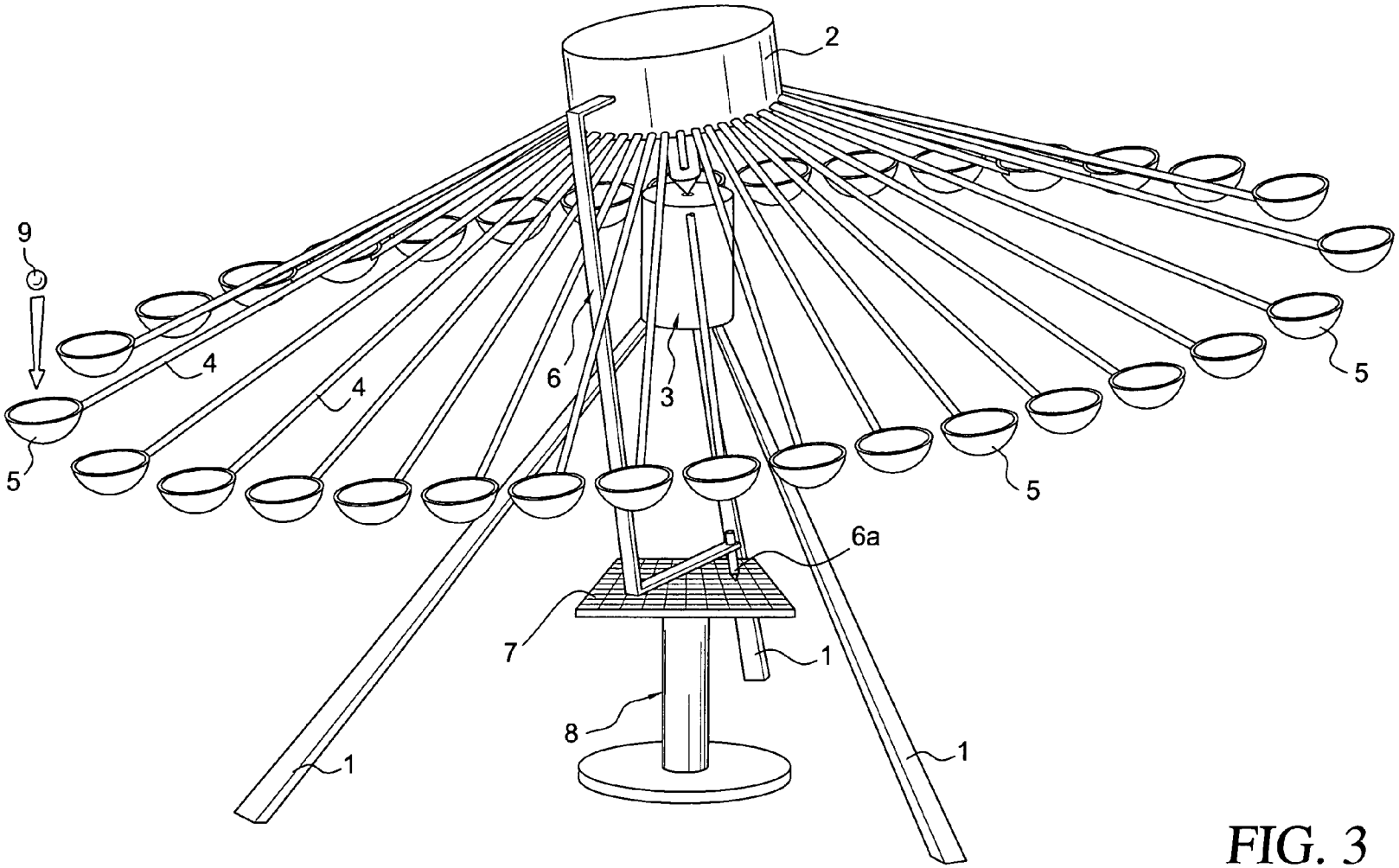
FIG. 3 is a front perspective view similar to FIG. 2 but showing a ball being placed in a cup on the left side, thereby tilting the mechanism to the left.
Figure 4:
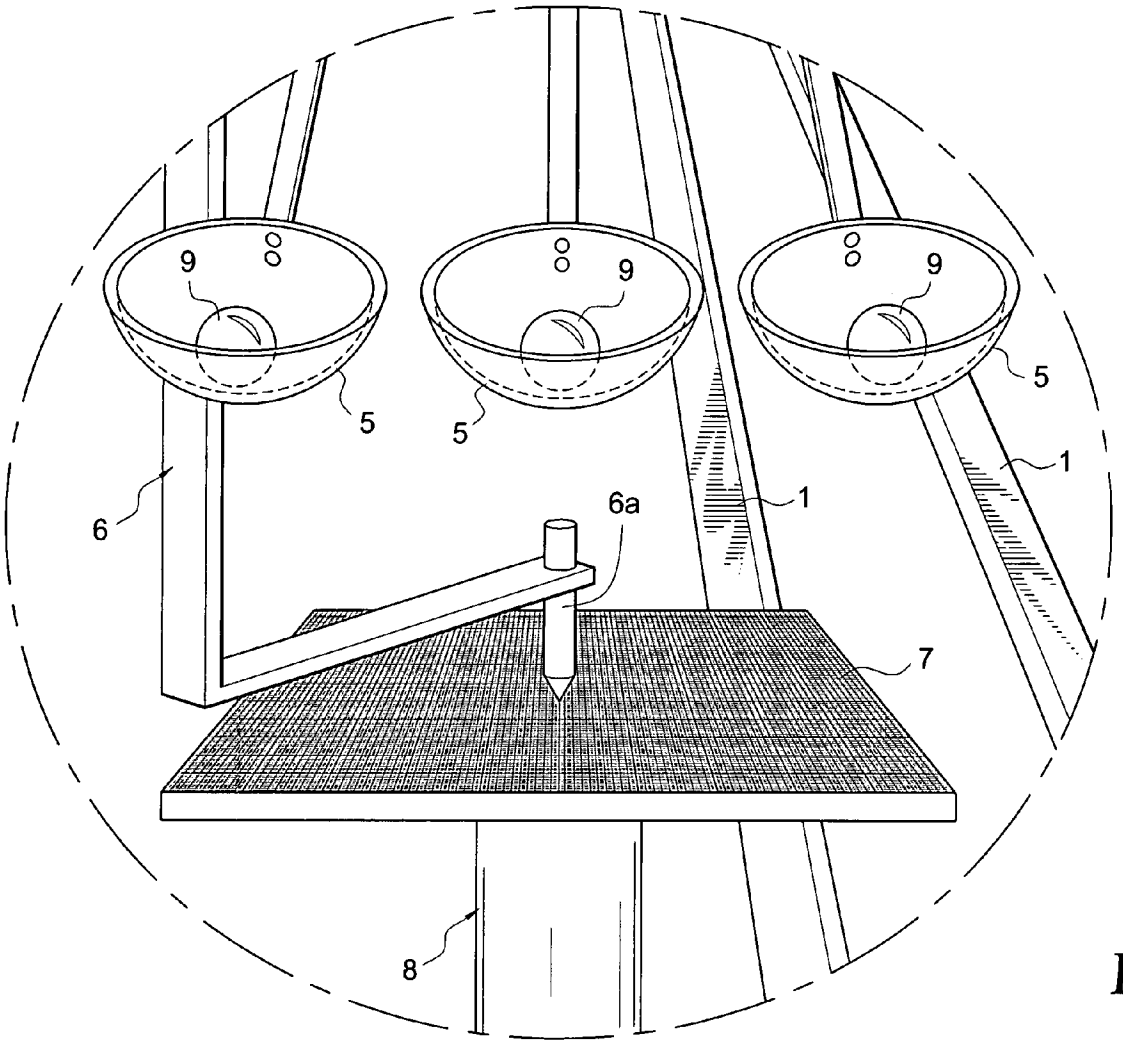
FIG. 4 is an enlarged fragmentary view of some of the cups having balls therein and the Cartesian coordinate graph and associated pointer.
Figure 5:
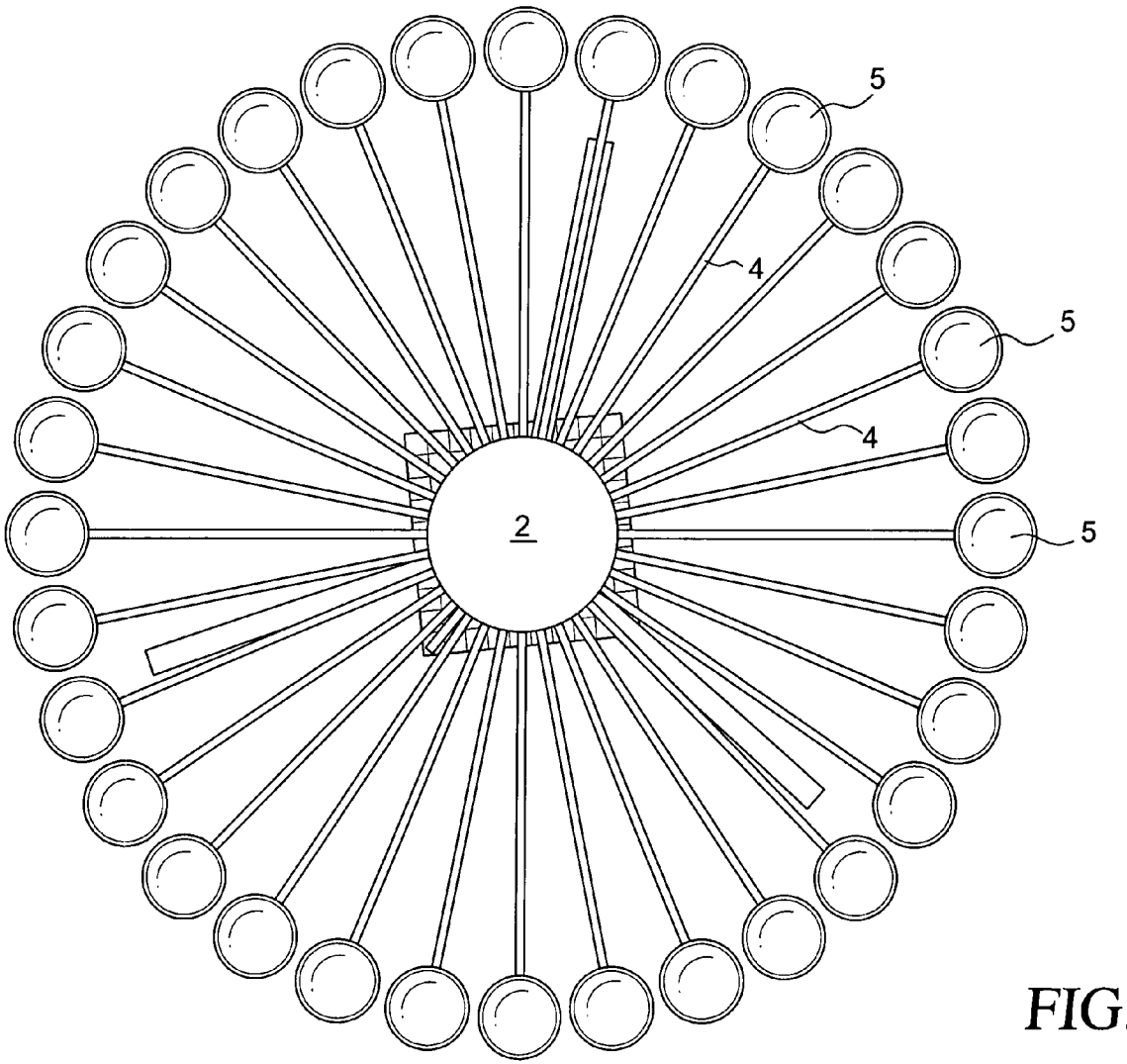
FIG. 5 is a top plan view of the balancing mechanism of the present invention.
Figure 6:
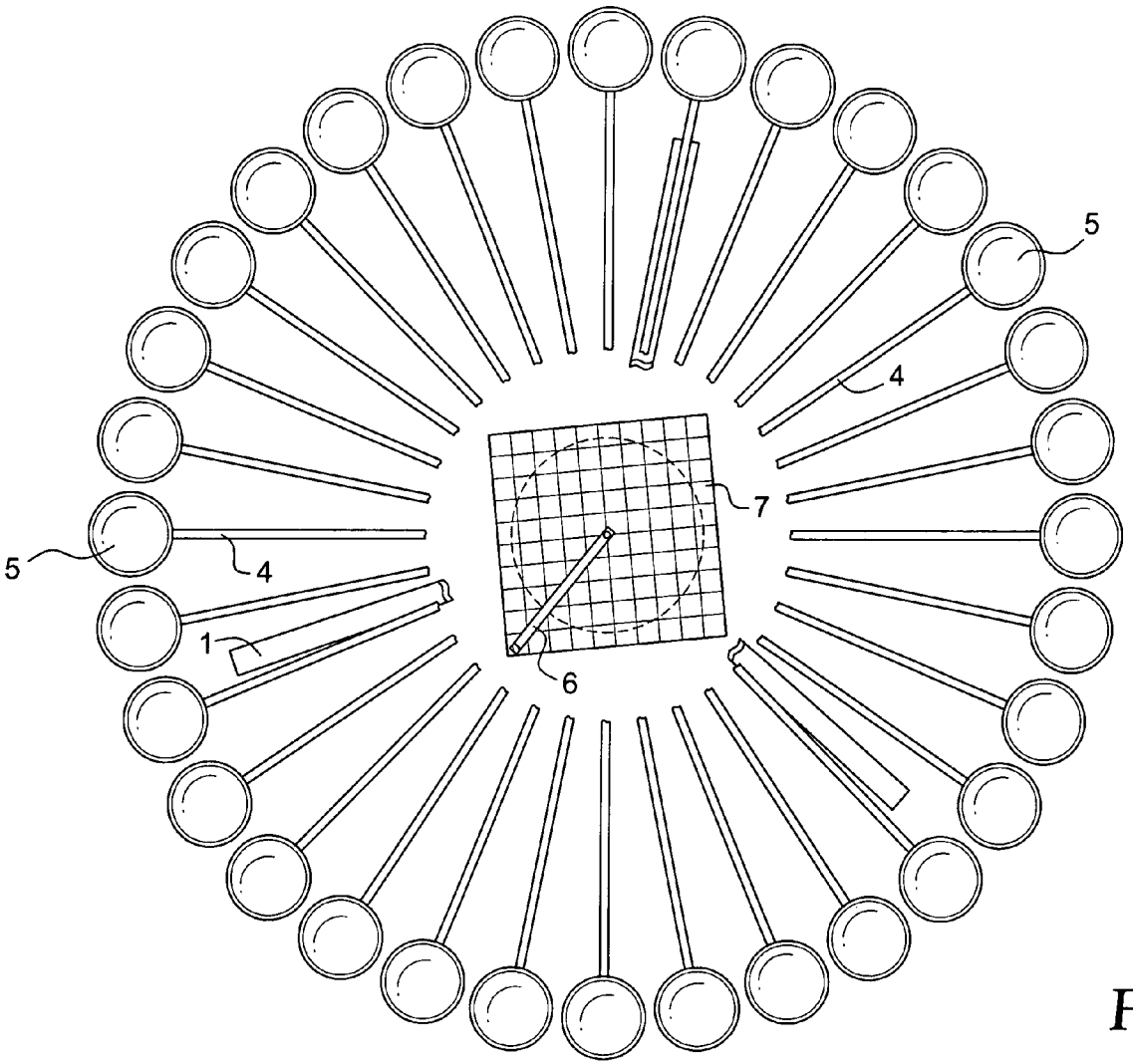
FIG. 6 is a fragmentary top plan view of the balancing mechanism.
Figure 7:
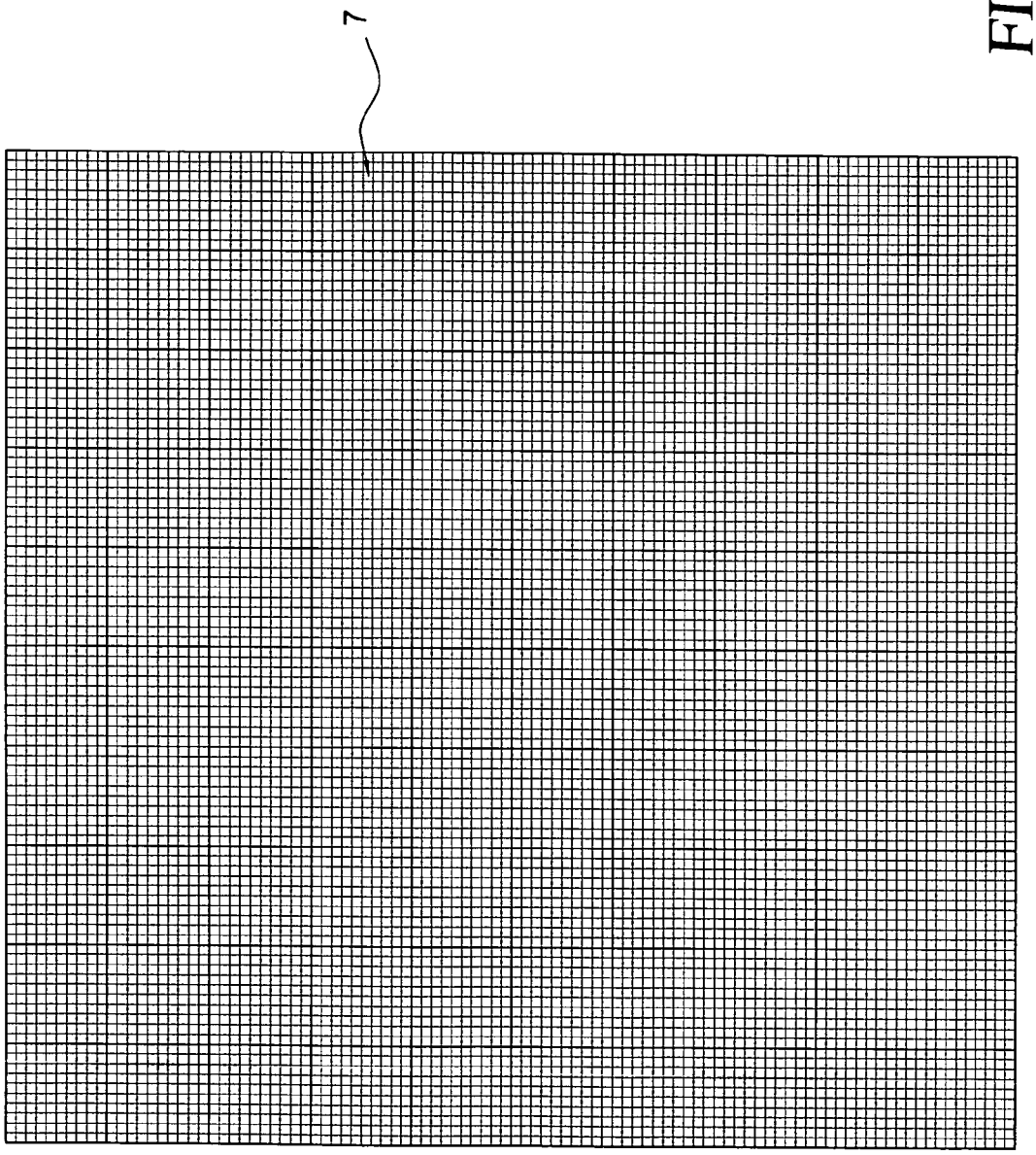
FIG. 7 is a top plan view of the cartesian coordinate graph.

In use, as will be seen in FIGS. 2 and 3, weights 9, such as marbles, are placed in selected cups 5 causing the arms 4 to tilt off center from the horizontal to an equilibrium position resulting in the pointer being positioned at a certain X,Y coordinate on the graph 7.

To play the equilibrium game, a plurality of players having a number of marbles, gather around the cups 5 and predict the final equilibrium position of the pointer 6*a* on the graph after all the balls have been placed in the cups 5. Each player is given five or ten marbles so as to enable the equilibrium of the mechanism to be attained without the pointer 6*a* ending at the origin of the X,Y axis on the graph 7. The game is won when a bettor bets the closest to the predicted coordinates.

It is to be understood that the form of the invention herewith shown and described is to be taken as a preferred example of the same, and that various changes in the shape, size and arrangement of parts may be resorted to without departing from the spirit of the invention or scope of the subjoined claims.

I claim:

1. A balancing mechanism for an equilibrium game comprising support means, a hub, a universal joint connecting said hub to said support means, a plurality of arms radiating outwardly from said hub, one end of each arm being connected to said hub, a container connected to the opposite end of each arm, indicator means connected to said hub, and a cartesian coordinate graph positioned centrally of said support means, whereby when weights are placed in the containers, the arms are caused to tilt off center from the horizontal to an equilibrium position resulting in the indicator means being positioned at a certain X,Y coordinate on the cartesian coordinate graph.

2. A balancing mechanism, according to claim 1, wherein the support means comprises a tripod.

3. A balancing mechanism, according to claim 1, wherein the universal joint comprises a base connected to said support means, a recess formed in the upper surface of said base, a depending spindle having a pointed end fixed to the bottom surface of said hub, said pointed end of said spindle being received in said recess.

4. A balancing mechanism, according to claim 1, wherein the indicator means comprises a pointer depending from said hub and extending downwardly to said cartesian coordinate graph.

* * * * *